US005504559A

United States Patent [19]

Ojima et al.

[11] Patent Number: 5,504,559

[45] Date of Patent: Apr. 2, 1996

[54] METHOD FOR IMAGE FORMATION

[75] Inventors: Seishi Ojima, Takatsuki; Izumi Osawa, Ikeda, both of Japan

[73] Assignee: Minolta Co., Ltd., Osaka, Japan

[21] Appl. No.: 294,836

[22] Filed: Aug. 29, 1994

[30] Foreign Application Priority Data

| | | | |
|---|---|---|---|
| Aug. 30, 1993 | [JP] | Japan | 5-214312 |
| Dec. 14, 1993 | [JP] | Japan | 5-313435 |
| Dec. 21, 1993 | [JP] | Japan | 5-322557 |
| Dec. 21, 1993 | [JP] | Japan | 5-322559 |
| Dec. 27, 1993 | [JP] | Japan | 5-329262 |

[51] Int. Cl.[6] ..... G03G 5/00; G03G 9/00

[52] U.S. Cl. ..... 355/211; 355/212; 430/67; 430/126

[58] Field of Search ..... 355/211, 212; 430/66, 67, 126, 107, 108, 109, 106.6

[56] References Cited

U.S. PATENT DOCUMENTS

| | | | |
|---|---|---|---|
| 3,900,588 | 8/1975 | Fisher | 430/107 X |
| 4,395,485 | 7/1983 | Kashiwagi et al. | 430/106.6 X |
| 4,601,968 | 7/1986 | Hyosu | 430/106.6 |
| 4,623,605 | 11/1986 | Kato et al. . | |
| 4,642,278 | 2/1987 | Tanigami et al. . | |
| 4,839,255 | 6/1989 | Hyosu et al. . | |
| 4,859,560 | 8/1989 | Nakamura et al. . | |
| 4,882,256 | 11/1989 | Osawa et al. . | |
| 4,940,644 | 7/1990 | Matsubara et al. | 430/109 |
| 4,950,571 | 8/1990 | Hotomi et al. | 430/66 X |
| 4,985,328 | 1/1991 | Kumagai et al. | 430/106.6 X |
| 5,066,558 | 11/1991 | Kikake et al. | 430/110 X |
| 5,082,756 | 1/1992 | Doi | 430/66 X |
| 5,212,039 | 5/1993 | Demizu et al. . | |
| 5,219,695 | 6/1993 | Tanikawa et al. | 430/106.6 |
| 5,219,696 | 6/1993 | Demizu et al. . | |
| 5,240,801 | 8/1993 | Hayashi et al. | 430/66 X |
| 5,256,509 | 10/1993 | Hayashi et al. | 430/66 |
| 5,310,615 | 5/1994 | Tanikawa | 430/106.6 |
| 5,350,657 | 9/1994 | Anno et al. | 430/110 X |
| 5,354,637 | 10/1994 | Shimamura et al. | 430/110 X |
| 5,364,720 | 11/1994 | Nakazawa et al. | 430/106.6 |
| 5,364,722 | 11/1994 | Tanikawa et al. | 430/110 |
| 5,370,957 | 12/1994 | Nishikiori et al. | 430/106.6 |
| 5,385,801 | 1/1995 | Terasaka et al. | 430/111 X |

FOREIGN PATENT DOCUMENTS 5-181306A 7/1993 Japan .

*Primary Examiner*—Matthew S. Smith

*Attorney, Agent, or Firm*—Burns, Doane, Swecker & Mathis

[57] ABSTRACT

The present invention relates to a method for image formation in which an electrostatic latent image is formed on an image supporting member having a carbon-based high-hardness surface coating layer. The electrostatic latent image is developed with a toner which includes resin particles composed of at least a binder resin and a colorant, specific fine particles fixed on the surface of the resin particles and post-treatment fine particles mixed with the resin particles on the surface of which the fine particles are fixed. The fine particles prevent the post-treatment fine particles from being embedded in the resin particles. The developed toner image is then transferred onto a transfer member to form the image.

43 Claims, 1 Drawing Sheet

METHOD FOR IMAGE FORMATION

BACKGROUND OF THE INVENTION

1. Field of the Invention

The present invention relates to a method for image formation, by which an electrostatic latent image formed on an image supporting member having a surface layer is developed with toner.

2. Description of the Prior Art

In recent years, the method for image formation, by which an electrostatic latent image formed on a photosensitive member having a surface layer is developed with toner, has been drawing attention. For example, in the electrophotography, there has been known a technique that an electrostatic latent image is formed on a photosensitive member having a carbon-based coating layer of high-hardness as a surface layer, and then developed with toner containing resin components and colorants (e.g., Japanese Patent Laid-Open Publications SHO 61-25154 and SHO 63-97962). Such a carbon-based high-hardness coating layer is so hard that many times repetition of image formation process would not cause the photosensitive member to be scraped.

However, if the image formation process is repeatedly executed by using the photosensitive member having a carbon-based high-hardness coating layer as a surface layer, such as a photosensitive member comprising a surface layer of amorphous silicon carbide and a photosensitive layer of amorphous silicon, or a photosensitive member comprising a surface layer formed of an amorphous hydrocarbon layer and a photosensitive layer formed of an organic photosensitive layer, there would arise problems of toner fusion and image flow. This problem of image flow will noticeably take place especially under high humidity environments. Since the surface layer of the photosensitive member is almost free from layer-scraping, electrical charging products, such as nitrates due to nitrogen oxides (NOx) and others generated in the charging process, in which the photosensitive member is uniformly electrically charged, will be accumulated on the surface layer while the image formation process is repeated. These charging yields cause the surface layer of the photosensitive member to lower in resistivity, such that the image flow may gradually occur particularly under high humidity environments.

The toner fusion is a phenomenon that the toner melts and adheres onto the surface of the photosensitive member. This phenomenon could be attributed to the following reasons A to C. That is, A: Carriers that have deteriorated due to long-term use adhere onto the surface of the photosensitive member and are embedded therein during the process of blade cleaning. The embedded carriers serves as nuclei and toner fuses on the photosensitive member surface during the process of blade cleaning. B: Minute projections generated in the production process of the photosensitive member serve as nuclei for toner fusion to take place. C: Because of deterioration or damage in the cleaner blade due to long-term use, abnormal stress may be applied to the toner during the process of cleaning, causing occurrence of toner fusion. Normal organic photosensitive members (OPC) undergo layer-scraping during the process of cleaning, so that fused toner is also removed at that time. On the other hand, the photosensitive member having the above mentioned hard surface layer, it is considered, does not involve layer-scraping, so that once toner fusion has occurred, the fusion grows with the subsequent use of the photosensitive member.

Also, the photosensitive member having a carbon-based high-hardness coating layer has a tendency that its residual potential will rise due to lower mobility of the coating layer. Accordingly, when image formation is repeatedly effected, fogging and toner scattering in white grounds are likely to occur.

Also, the aforementioned photosensitive member having a carbon-based high-hardness coating layer causes the cleaning blade to undergo quite great stress during the process of blade cleaning, compared with ordinary organic photosensitive members. The reason could be that while an organic photosensitive member has its surface scraped by the blade to some extent so that the stress applied to the blade is relaxed, the photosensitive member having a carbon-based high-hardness coating layer involves almost no occurrence of layer scraping. Thus, there would arise a problem that a cleaning defect of the toner slipping through the blade is likely to occur due to deformation of the blade, and another problem that the slipped-through toner accumulates on the back face of the blade, causing a remaining latent image on the photosensitive member surface to be developed.

SUMMARY OF THE INVENTION

The object of the present invention is to provide a method for image formation, in which even when image formation process is repeated by using an image supporting member having a carbon-based high-hardness coating layer as a surface layer, there will not occur image flow, fogging in white grounds, toner fusion, cleaning defects, or image noise.

The present invention relates to a method for image formation, comprising the steps of:

forming an electrostatic latent image on an image supporting member having a carbon-based high-hardness surface coating layer;

developing the electrostatic latent image with a toner which comprises resin particles composed of at least a binder resin and a colorant, specific fine particles fixed on the surface of the resin particles and post-treatment fine particles mixed with the resin particles on the surface of which the fine particles are fixed, said fine paricles preventing the post-treatment fine particles from being embedded in the resin particles; and transferring a resulting toner image onto a transfer member.

DETAILED DESCRIPTION OF THE INVENTION

Figure 1:
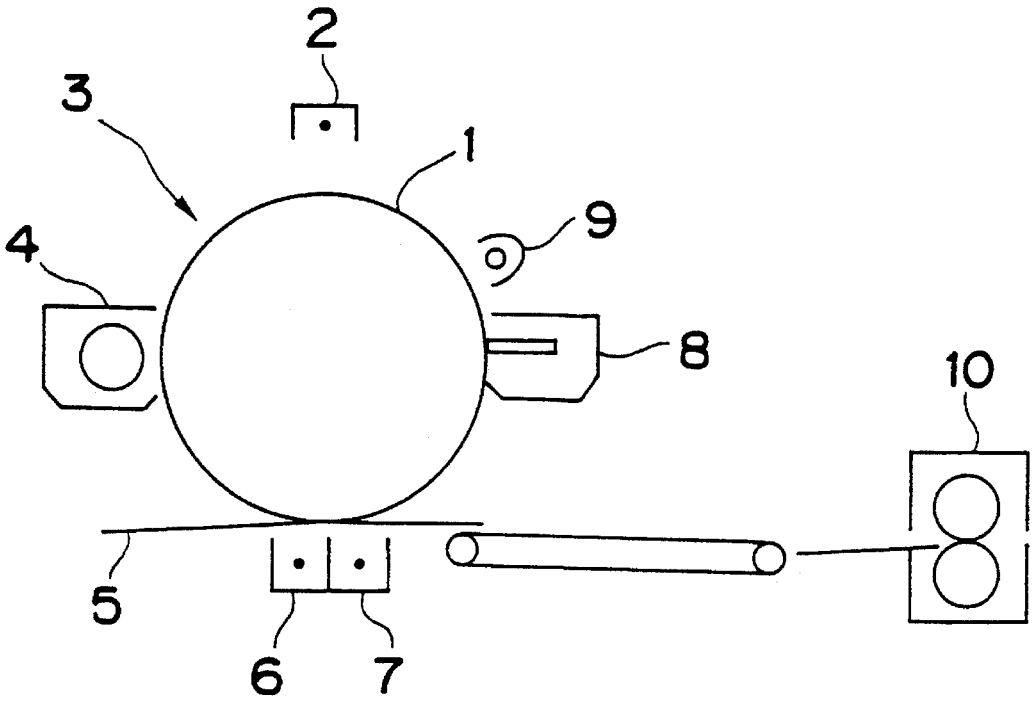
FIG. 1 is a schematic view of configuration of an apparatus for image formation which embodies a method for image formation according to the present invention.

The present invention provides a method for image formation, in which even when image formation process is repeated by using an image supporting member having a carbon-based high-hardness coating layer as a surface layer, there will not occur image flow, fogging in white grounds, toner fusion, cleaning defects, or image noise.

The present invention can be accomplished by using a toner in which fine particles for preventing post-treatment agents from being embedded are fixed on toner particle surfaces and to which post-treatment fine particles are externally added.

Accordingly, the present invention relates to a method for image formation, comprising the steps of:

forming an electrostatic latent image on an image supporting member having a carbon-based high-hardness surface coating layer;

developing the electrostatic latent image with a toner which comprises resin particles composed of at least a binder resin and a colorant, fine particles for preventing post-treatment fine particles from being embedded and post-treatment fine particles, said fine particles fixed on the surface of the resin particles and selected from titanium oxide-based fine particles, magnetic fine particles, silica fie particles and organic fine particles, and said post-treatment fine particles mixed with the resin particles on the surface of which the fine particles are fixed; and transferring a resulting toner image onto a transfer member.

The present invention also relates to a method for image formation, comprising the steps of:

forming an electrostatic latent image on an image supporting member having a carbon-based high-hardness surface coating layer;

developing the electrostatic latent image with a toner which comprises resin particles composed of at least of a binder resin and a colorant, alumina fine particles fixed on the surface of the resin particles and post-treatment fine particles mixed with the resin particles on the surface of which the alumina fine particles are fixed and said post-treatment fine particles having a BET specific surface area of not more than 300 $m^2/g$; and transferring a resulting toner image onto a transfer member.

In the present invention, it has been found that the problems of image flow, fogging in white grounds, toner fusion, cleaning defects, and image noise can be solved by developing an electrostatic latent image held on an image supporting member having a carbon-based high-hardness coating layer as a surface layer with the use of a toner in which fine particles for preventing post-treatment agents from being embedded are fixed on its surface and thereafter post-treatment fine particles are externally added. The reason why such problems can be solved by the use of such a particular developer, although unclear, can be considered as follows.

The statement that post-treatment fine particles are externally added to toner particles herein refers to a state that post-treatment fine particles are interveniently present between toner core particles and surface layer of the image supporting member so as to be movable therebetween like a lubricant. In this state, the post-treatment fine particles make sliding contact with the surface layer of the image supporting member and the resulting physical sliding-contact force acts to scrape and remove electrical charging products accumulated on the surface layer mechanically and physically. However, since toner particles include fixing components, externally added post-treatment fine particles will be embedded in the toner particles with repeated printing operation, resulting in that the scraping and removing effect could not be exerted sufficiently. The present inventors have found it effective in prevention of image flow to fix particular fine particles on toner particle surfaces in order to prevent the post-treatment fine particles from being embedded with repeated printing operation. In more detail, the fixed fine particles allow the toner particle surfaces to be apparently hardened, so that fine particles externally added can be prevented from being embedded. In the present invention, the fine particles to be fixed should be selected from the viewpoint that the fixed particles will not affect the chargeability and other performances inherent in toner or the viewpoint of such a durability that the post-treatment fine particles can be effectively prevented from being embedded even after many times of repeated printing. Specifically, at least one kind of fine particles for preventing post-treatment agents from being embedded, which is selected from among titanium oxide-based fine particles, magnetic fine particles, silica fine particles, organic fine particles and alumina fine particles, is fixed onto the toner core particle surfaces. It is noted that the "fixed" herein refers to a state that at least part of the fine particles are embedded and immobilized in the toner particles. It is desirable that preferably 30% by volume or more of the fine particles for preventing post-treatment agents from being embedded are embedded and fixed in the toner particles.

Also, it is considered that the problem of toner fusion can be prevented by the action that fused toner is removed by the sliding-contact force to the surface of the image supporting member.

The image supporting member having a carbon-based high-hardness coating layer has a tendency that the residual potential will rise due to lower mobility of the coating layer, such that when the image formation process is repeatedly effected, fogging in white grounds and toner scattering are likely to occur. In contrast to this, use of magnetic fine particles as the fine particles to be fixed enhances the magnetic constraint force of toner to the developing roller, which is a developer-supporting member, producing a large effect of preventing fogging and toner scattering.

Further, use of organic fine particles, which are higher in hardness than the binder resin of toner, greatly contributes to the solution of the cleaning defect problem. This could be attributed to the fact that fixation of organic fine particles and external addition of post-treatment fine particles enhance the slipperiness of toner at the cleaning blade so that the problems of cleaning defects and toner accumulation at the back face of the blade can be solved.

The titanium oxide-based fine particles to be fixed in the present invention may be $TiO_2$, $MTiO_3$ (M=Ba, Sr, Ca, or other bivalent metals), $TiO_2$ whose surface is treated with a tin oxide-based conductive layer, and the like.

The magnetic fine particles to be used for fixation may be fine particles of known magnetic materials, for example, metals exhibiting ferromagnetism such as cobalt, iron, and nickel, metal alloys of aluminum, cobalt, iron, lead, magnesium, nickel, zinc, antimony, beryllium, bismuth, cadmium, calcium, manganese, selenium, titanium, tungsten, and vanadium, as well as mixtures and oxides of these metals, and ferrites.

Silica fine particles to be used for fixation may be $SiO_2$ fine particles synthesized by vapor phase processing such as arc processing, flame hydrolysis, and plasma processing, or wet processing such as silica-sol processing and precipitation processing, or the like.

The organic fine particles used for fixation are desirably those having hardness higher than the binder resin of toner, preferably 10 or more higher in Rockwell hardness than the binder resin of toner. When the hardness of the organic fine particles is smaller than that of the binder resin of toner, the effect of preventing post-treatment fine particles from being embedded becomes insufficient. Further, differing depending on the type of binder resin of toner used, the organic fine particles desirably has a Rockwell hardness of 90 or more, preferably 110 or more, from the viewpoint of preventing post-treatment fine particles from being embedded. It is noted that the Rockwell hardness was measured in accordance with the ASTM D785 standard test.

Specifically, as the organic fine particles used for fixation, available are organic resin fine particles such as styrenes, acrylic resins, methacylic resins, benzoguanamine, silicone, Teflon, polyethylene and polypropylene, which may be granulated by wet polymerization processing such as emulsion polymerization, soap-free emulsion polymerization and nonaqueous dispersion polymerization, or by vapor phase polymerization processing. Organic metal salt compounds such as aluminum stearate, magnesium stearate and zinc stearate may be used. Those organic fine particles should be higher in hardness than the binder resin of toner.

The fine particles for preventing post-treatment agents from being embedded desirably have a volume-average particle size of primary particles in the range of 0.01 to 2 μm. The titanium oxide-based fine particles or silica fine particles are desirably added in such an amount that the fine particles sufficiently coat the toner surface, preferably 0.5% to 3% by weight relative to the toner particles.

The magnetic fine particles are desirably added in such an amount that the magnetic fine particles sufficiently coat the toner surface, preferably 1.0% to 10% by weight relative to the toner particles.

As alumina fine particles used for fixation, it is desirable that the alumina fine particles have a BET specific surface area of 10–200 $m^2/g$, preferably 30–100 $m^2/g$.

The alumina fine particles are desirably added in such an amount that the alumina fine particles sufficiently coat the toner surface, preferably 0.5% to 3% by weight relative to the toner particles.

Desirably, the titanium oxide-based fine particles, magnetic fine particles, silica fine particles and alumina fine particles are subjected to hydrophobic treatment with a hydrophobic-treatment agent such as silane coupling agents, titanium coupling agents, higher fatty acids, and silicone oil. In this case, the toner can be suppressed from variations in characteristics due to variations in the use environment.

The specific apparatus for fixing fine particles for preventing post-treatment agents from being embedded in the present invention is exemplified by Henschel mixer (made by Mitsui Miike Kakoki K.K.), hybridizer (made by Nara Kikai Seisakusho K.K.), homogenizer (made by Nippon Seiki K.K.), Criptron system (made by Kawasaki Jukogyo K.K.), Turbo Mill (made by Turbo Kogyo K.K.), and the like. By using these apparatus, part of the fine particles are embedded in the toner bulk and fixed.

Without such fixation, the fine particles for preventing post-treatment agents from being embedded would be separated from the toner core particle surfaces, such that externally added fine particles would be embedded in the toner core particles at the separation places as stated before. The result of this would be an disadvantage that the scraping and removing effect of the externally added fine particles could not be exerted sufficiently.

The post-treatment fine particles to be externally added in the present invention are exemplified by inorganic fine particles with a volume average particle size of about 0.01 to 5 μm of silica, titanium dioxide, alumina, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, zinc stearate and the like.

Desirably, these inorganic fine particles are subjected to hydrophobic treatment with a hydrophobic-treatment agent such as silane coupling agents, titanium coupling agents, higher fatty acids, and silicone oil. In this case, the toner can be suppressed from variations in characteristics due to variations in the use environment.

Also, the post-treatment fine particles are exemplified, without being limited to inorganic fine particles, by various types of organic fine particles with a volume average particle size of 0.01 to 5 μm such as styrenes, acrylic resins, methacylic resins, benzoguanamine, silicone, Teflon, polyethylene and polypropylene, which are granulated by wet polymerization processing such as emulsion polymerization, soap-free emulsion polymerization, and nonaqueous dispersion polymerization, or by vapor phase polymerization processing.

The post-treatment fine particles are desirably added in an amount of about 0.05% to 5% by weight, preferably 0.1% to 3% by weight, relative to the toner particles, from the two points of view, imparting fluidity required as toner, and scraping and removing electrical charging yields accumulated on the surface layer of the image supporting member.

As stated before, unless fine particles are externally added, the effect of scraping and removing the electrical charging yields accumulated on the surface layer of the image supporting member could not be exerted. Also, since toner fluidity would significantly lower without the external addition of fine particles, there would arise another disadvantage that toner could not be fed to the developing unit stably.

In particular in the case where alumina fine particles are used as fine particles for preventing post-treatment fine particles from being embedded, it is preferable that post-treatment fine particles having a BET specific surface area of not more than 300 $m^2/g$, preferably 30 to 200 $m^2/g$ are used. Toner to which fine particles with a BET specific surface area of not more than 300 $m^2/g$ greatly contributes to the solution of the image blur problem. If the surface area is larger than 300 $m^2/g$, the toner to which the fine particles are fixed results in insufficient fluidity, so that toner are likely to agglomerate. Such toner agglomerates causes not only image noise but also damage of the cleaning blade. The photosensitive member having a carbon-based high-hardness coating layer is a highly durable photosensitive member and therefore is used for longer term, compared with organic photosensitive members and the like. However, if any blade defect has occurred, the surface of the photosensitive member is more likely to be subject to scratches and toner fusion. Also, the photosensitive member is almost free from layer-scraping by virtue of the layer's high hardness. Thus, it is considered that scratches and toner fusion will not be removed but remain.

To externally add the post-treatment fine particles in the present invention, it is proper to mix the externally fine particles with toner particles to which fine particles are fixed. The specific apparatus for the treatment can be exemplified by a Henschel mixer, homogenizer, and Hi-X (made by Nittetsu Kogyo K.K.). It is desirable to use the same apparatus for the fixation and the external addition treatment in terms of simplification of treatment and cost reduction, and to carry out the fixation and the external addition treatment by controlling the treatment conditions such as the number of revolutions. As stated before, without externally adding post-treatment fine particles, the effect of scraping and removing electrical charging yields accumulated on the surface layer of the image supporting member could not be exerted. Also, without the external addition of post-treatment fine particles, toner fluidity would significantly lower, so that the toner could not be fed to the developing unit stably.

The present invention employs an image supporting member having a carbon-based high-hardness coating layer. The carbon-based high-hardness coating layer is herein defined by an uppermost surface layer of the image supporting member which has a 50 or more Vickers hardness and whose proportion occupied by the number of carbon atoms is not less than 30% relative to the total atomic number. The carbon-based high-hardness coating layer preferably has a Vickers hardness of not less than 300 in terms of durability. More specifically, the layer is exemplified by amorphous hydrocarbon layers, amorphous silicon carbide layers, or resin layers composed of homopolymers such as polyester, polyurethane and polyamide, or copolymers containing these resin components. Among these, amorphous hydrocarbon layers are preferable from the viewpoint of durability and the viewpoint of a property of forming a layer onto the organic photosensitive layer that is low cost and high performance.

The specific method for forming a carbon-based high-hardness coating layer can be exemplified by dry processes such as the plasma CVD process, sputtering and vacuum deposition, and wet processes such as immersion application, dipping and spraying, and the like.

The image supporting member having a carbon-based high-hardness coating layer as a surface layer herein can be exemplified by electrophotographic photosensitive members having the carbon-based high-hardness coating layer as an uppermost surface layer, or those having the carbon-based high-hardness coating layer as an uppermost surface layer of a dielectric member used in a system in which an electrostatic latent image is formed directly on the image supporting member, such as the ion flow system.

The specific image supporting member having a carbon-based high-hardness coating layer as a surface layer can be exemplified by photosensitive members comprising a surface layer of amorphous silicon carbide and a photosensitive layer of amorphous silicon, or photosensitive members comprising a surface layer formed of an amorphous hydrocarbon layer and a photosensitive layer formed of an organic photosensitive layer.

The toner generally contains colorants in the binder resin. The toner applicable to the present invention may be one obtained in such a way that fine particles for preventing post-treatment agents from being embedded are fixed on the surface of the toner and thereafter the post-treatment fine particles are externally added. Additionally, the toner may contain additives such as an offset inhibitor, magnetic materials, charge controlling agents, and the like, as required.

As the binder resin, usable are thermoplastic resins or thermosetting resins such as styrene resins, acrylic resins, methacrylic resins, styrene-acrylic resins, styrene-butadiene resins, olefinic resins, polyester resins, epoxy resins, urethane resins, amide resins and phenol resins, and their copolymers, block polymers, graft polymers, and polymer blends.

Such a resin used in the present invention desirably have such number-average molecular weight Mn and weight-average molecular weight Mw that $1000 \leqq Mn \leqq 20000$ and $2 \leqq Mw/Mn \leqq 80$ and more desirably, for the number-average molecular weight, $2000 \leqq Mn \leqq 15000$. Also, the resin desirably has a glass transition point of 55° C. to 70° C. and a softening point of 80° C. to 140° C.

As the colorant, usable are such black pigments as carbon black, copper oxide, manganese dioxide, aniline black, activated carbon, ferrite and magnetite.

Such yellow pigments are also usable as lead yellow, zinc yellow, cadmium yellow, yellow oxide, mineral fast yellow, nickel titanium yellow, nables yellow, naphthol yellow S, hansa yellow G, hansa yellow 10G, benzidine yellow G, benzidine yellow GR, quinoline yellow lake, permanent yellow NCG, and tartrazine lake.

Such red pigments are also usable as chrome orange, molybdenum orange, permanent orange GTR, pyrazolone orange, vulcan orange, indanthrene brilliant orange GK, fire red, cadmium red, red lead, permanent red 4R, lithol red, pyrazolone red, watchung red, lake red C, lake red D, brilliant carmine 6B, eosine lake, rhodamine lake B, alizarin lake, brilliant carmine 3B, permanent orange GTR, vulcan fast orange GG, permanent red F4RH, and permanent carmine FB.

Such blue pigments are also usable as prussian blue, cobalt blue, alkali blue lake, victoria blue lake, and phthalocyanine blue.

In general these colorants are contained at an amount of 1 to 20 parts by weight, preferably 3 to 15 parts by weight relative to 100 parts by weight of resin in the toner.

As the offset inhibitor, available are low molecular weight polyethylene wax, low molecular weight oxidation type polyethylene wax, low molecular weight polypropyrene wax, low molecular weight oxidation type polypropyrene wax, higher fatty acid wax, higher fatty acid ester wax, sazole wax and the like. They may be used singly or in combination of two or more types.

The offset inhibitor should be used in such a proportion of 1 to 15 parts by weight, preferably 2 to 8 parts by weight relative to 100 parts by weight of resin in the toner.

As the magnetic material, usable are fine particles of known magnetic materials, for example, metals exhibiting ferromagnetism such as cobalt, iron, and nickel, metal alloys of aluminum, cobalt, iron, lead, magnesium, nickel, zinc, antimony, beryllium, bismuth, cadmium, calcium, manganese, selenium, titanium, tungsten and vanadium, as well as mixtures and oxides of these metals, and ferrites.

When magnetic material particles are internally added into the toner, its proportion is desirably 1 to 80 parts by weight, preferably 5 to 60 parts by weight relative to 100 parts by weight of resin in the toner.

As the charge controlling agent, such positive-charge controlling agents are usable as Nigrosine base EX, quaternary ammonium salt, polyamine compounds and imidazole compounds.

Such negative-charge controlling agents are usable as chrome complex salt type azo dyes, copper phthalocyanine dyes, chrome complex salt, zinc complex salt, aluminum complex salt, and carix allene compounds.

These charge controlling agents should be used in a proportion of 0.1 to 10 parts by weight, preferably 0.5 to 5 parts by weight relative to 100 parts by weight of resin in the toner.

The toner, into which fine particles for preventing post-treatment agents from being embedded has been fixed, preferably has a volume average particle size of about 5 to 20 μm. When a particle size of the toner is too small, cleaning defect takes place. When a particle size of the toner is too great, resolution power reduces and toner scattering increases. Also, when a high resolution image is reproduced, the toner used preferably has a volume average particle size of 5 to 10 μm.

The above-mentioned toner may be used as a one-component developer or a two-component developer.

When the toner is used as a two-component developer, the above-mentioned toner and a known carrier may be used in combination.

FIG. 1 outlines the configuration of an image forming apparatus which embodies the image forming method according to the present invention. In FIG. 1, there are shown a photosensitive drum 1, a corona charger 2, exposure light 3, a developing unit 4, transfer paper 5, a transfer charger 6, a separation charger 7, a cleaning unit 8, an eraser lamp 9 and a fixing unit 10.

The photosensitive drum 1 is uniformly electrically charged by the corona charger 2. Then, exposure light 3 is applied to the photosensitive drum 1 according to image information, whereby an electrostatic latent image is formed on the surface of the photosensitive drum 1. The electrostatic latent image is developed with later-described toner accommodated in the developing unit 4. The resulting toner image is transferred onto the transfer paper 5 by the transfer charger 6. The transfer paper 5 having the toner image is separated from the photosensitive drum 1 by the separation charger 7. The toner image held on the transfer paper 5 is fixed by the fixing unit 10 so that a fixed image is obtained. Meanwhile, the photosensitive drum 1, from which the transfer paper 5 has been separated, has residual toner removed by the blade of the cleaning unit 8, and has residual charges discharged by the eraser lamp 9, thus ready for formation of the next image.

Used as the toner to be accommodated in the developing unit 4 is toner which is obtained by fixing on its surface, fine particles for preventing post-treatment agents from being embedded, and thereafter externally adding thereto post-treatment fine particles.

EXAMPLES

Now the present invention is described in more detail with concrete experimental examples.

PRODUCTION OF PHOTOSENSITIVE MEMBER 1

Positively Chargeable Photosensitive Member

A photosensitive member with an a-Si photosensitive layer and an a-SiC surface protective layer laminated on an electrically conductive substrate in this order was prepared by means of a glow-discharge decomposition apparatus disclosed in Japanese Patent Laid-Open Sho 61-25154 under the following conditions.

| Conditions For Forming a-Si Photosensitive Layer: | |
|---|---|
| Material gas (gas flow rate): | $H_2$ (486.5 sccm), $SiH_4$ (90 sccm), $B_2H_6$ (22.5 sccm), $O_2$ (1 sccm) |
| Pressure: | 1.0 Torr |
| Frequency: | 13.56 MHz |
| Power: | 250 W |
| Substrate Temperature: | 240° C. |
| Discharge Time: | 6 hr |
| Conditions For Forming a-SiC Surface Protective Layer (Carbon-Based High-Hardness Coating Layer): | |
| Material gas (gas flow rate): | $H_2$ (486.5 sccm), $SiH_4$ (90 sccm), $B_2H_6$ (90 sccm), $C_2H_4$ (270 sccm) |
| Pressure: | 1.0 Torr |
| Frequency: | 13.56 MHz |
| Power: | 250 W |
| Substrate temperature: | 240° C. |
| Discharge time: | 2 min |

In the above photosensitive member, the layer thickness of the a-Si photosensitive layer was about 20 μm, and that of the a-SiC surface protective layer was about 0.1 μm. Vickers hardness of the a-SiC surface protective layer was 3,000. The carbon content of the a-SiC surface protective layer was about 75 atomic %.

PRODUCTION OF PHOTOSENSITIVE MEMBER 2

Negatively Chargeable Photosensitive Member

A photosensitive member was produced in which an organic charge-generating layer, an organic charge-transporting layer, and a surface protective layer formed of an amorphous carbon layer were formed on an electrically conductive substrate in the order.

The organic charge-generating layer and the organic charge-transporting layer were obtained by applying a coating solution satisfying the following conditions by a dipping method.

ORGANIC CHARGE-GENERATING LAYER

Organic Photosensitive Layer

| | |
|---|---|
| Azo compound represented by the following structural formula: | 0.45 parts by weight |

Formula [1]

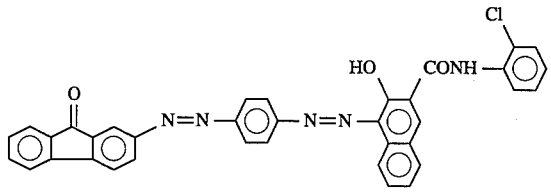

| | |
|---|---|
| Polyester resin (Vylon 200; made by Toyo Boseki K.K.) | 0.45 parts by weight |
| Cyclohexanone | 50 parts by weight |
| Organic Charge-Transporting Layer (Organic Photosensitive Layer) | |
| Styryl compound represented by the following structural formula: | 10 parts by weight |

Formula [2]

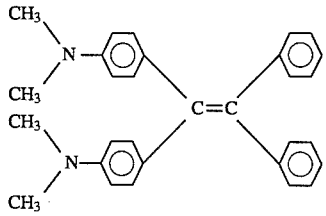

| | |
|---|---|
| Polycarbonate resin (Panlite K-1300; made by Teijin Kasei K.K.) | 7 parts by weight |
| 1,4-dioxane | 40 parts by weight |

The layer thickness of the organic charge-generating layer was about 0.3 μm, and that of the organic charge-transporting layer was about 20 μm.

The amorphous carbon-layer surface protective layer was formed on the organic charge-transporting layer by a glow-discharge decomposition apparatus, which is already disclosed in Japanese Patent Laid-Open Sho 63-97962 under the following conditions:

| | |
|---|---|
| Material gas (gas flow rate): | $H_2$ (300 sccm), butadiene (15 sccm) |
| Pressure: | 1.0 Torr |
| Frequency: | 100 KHz |
| Power: | 150 W |
| Substrate temperature: | 50° C. |
| Discharge time: | 3 min |

The layer thickness of the amorphous carbon layer was 0.11 μm. Vickers hardness of the amorphous carbon layer was 1,000. The carbon content of the amorphous carbon layer was about 48 atomic %.

PRODUCTION OF CARRIER 1

The following materials were well mixed and then fusion-mixed by a twin-screw extrusion kneader, followed by cooling:

| | |
|---|---|
| Polyester resin (Mn: 5000, Mw: 115000, Tg: 67° C., Tm: 123° C.) | 100 parts by weight |
| Ferrite fine particles (MFP-2; made by TDK K.K.) | 500 parts by weight |
| Silica fine particles (Aerosil #200; made by Nippon Aerosil K.K.) | 3 parts by weight |

The cooled product was roughly pulverized, and then finely pulverized by a jet mill, and further classified by an air classifier. The resulting binder-type carrier was 60 μm in volume-average particle size and $5.8\times10^{13}$ Ωcm in electrical resistance.

Positively Chargeable Toner

PRODUCTION OF TONER PARTICLE A

The following materials were well mixed and then fusion-mixed by a twin-screw extrusion kneader, followed by cooling:

| | |
|---|---|
| Styrene-acrylic copolymer resin (Mn: 5,400, Mw: 156,000, Tg: 60° C., Tm: 120° C.) (Rockwell hardness: 80) | 100 parts by weight |
| Colorant: carbon black (Raven 1,250; made by Columbia Carbon K.K.) | 10 parts by weight |
| Offset inhibitor: wax (Viscol 550P; made by Sanyo Kasei Kogyo K.K.) | 3 parts by weight |
| Charge controlling agent: quaternary ammonium salt (P-51; made by Orient Kagaku Kogyo K.K.) | 3 parts by weight |

The cooled product was roughly pulverized, and then finely pulverized by a jet mill, and further classified by an air classifier. Thus Toner Particle A was obtained. The resulting Toner Particle A was 9.5 μm in volume-average particle size and $5\times10^{15}$ Ωcm in electrical resistance.

Negatively Chargeable Toner

PRODUCTION OF TONER PARTICLE B

The following materials were well mixed and then fusion-mixed by a twin-screw extrusion kneader, followed by cooling:

| | |
|---|---|
| Styrene acrylic copolymer resin (Mn: 5,400, Mw: 156,000, Tg: 60° C., Tm: 120° C.) (Rockwell hardness: 80) | 100 parts by weight |
| Colorant: carbon black (Raven 1250; made by Columbia Carbon K.K.) | 10 parts by weight |
| Offset inhibitor: wax (Viscol 550P; made by Sanyo Kasei Kogyo K.K.) | 3 parts by weight |
| Charge controlling agent: chrome complex salt type azo dye (S-34; made by Orient Kagaku Kogyo K.K.) | 3 parts by weight |

The cooled product was roughly pulverized, and then finely pulverized by a jet mill, and further classified by an air classifier. Thus Toner Particle B was obtained. The resulting Toner Particles B was 11.0 μm in volume-average particle size and $7\times10^{15}$ Ωcm in electrical resistance.

EXAMPLE I-1

To 100 parts by weight of the Toner Particle B was added 0.5 parts by weight of titanium oxide fine particles (volume-average particle size of primary particle: 0.05 μm, Aerosil T805; made by Nippon Aerosil K.K.). The mixture was processed by Henschel mixer (made by Mitsui Miike Kako K.K.) at 3,000 rpm for 5 min to fix the fine particles on the toner particle surfaces.

Further, 0.1 part by weight of silica fine particles (R972; made by Nippon Aerosil K.K.) was added to the resultant Toner Particle B and processed at 1,000 rpm for 1.5 min so as to be externally added to the Toner Particle B. The obtained toner was 11.1 μm in volume-average particle size and $7\times10^{15}$ Ωcm in electrical resistance.

A developer in which the resulting toner and the foregoing carrier were mixed at a mixing ratio of 5:95 was accommodated in the developing unit of a copying machine EP8600 (made by Minolta Camera K.K.) which had been so modified as to allow the aforementioned Photosensitive Member 1 to be used. Then a durability test with respect to copy of about 600,000 times was carried out.

In more detail, test charts were copied each 200,000 copies at room temperature and thereafter 10,000 sheets of paper were copied under a 30° C. temperature, 85% humidity environment. Then copy images were evaluated.

| | |
|---|---|
| ○: | Image flow was not recognized. |
| Δ: | Slight image flow was recognized at character edge portions. |
| x: | Flow of characters was recognized on the whole. |
| xx: | Characters could not be discriminated. |

Copy images ranked equal to or higher than Δ are acceptable from the standpoint of practical use. Results of the evaluation are shown in Table I-1.

EXAMPLE I-2

To 100 parts by weight of the Toner Particle A was added 0.5 parts by weight of strontium titanate fine particles (volume-average particle size: 0.6 μm). The mixture was processed by Henschel mixer (made by Mitsui Miike Kako K.K.) at 3,500 rpm for 3 min to fix the fine particles on the toner particle surfaces.

Further, 0.1 part by weight of alumina fine particles (C604; made by Nippon Aerosil K.K.) was added to the resultant Toner Particle A and processed at 1,000 rpm for 1.5 min so as to be externally added to the toner particles. The resulting toner was 9.7 μm in volume-average particle size and $5\times10^{15}$ Ωcm in electrical resistance.

A developer in which the resulting toner and the foregoing carrier were mixed at a mixing ratio of 5:95 was accommodated in the developing unit of the copying machine EP8, 600 (made by Minolta Camera K.K.) which had been so modified as to allow the aforementioned Photosensitive Member 2 to be used. Then the same durability test with respect to copy as in Example I-1 was carried out. Results of the experiment are shown in Table I-1.

EXAMPLES I-3 TO I-9

The durability test with respect to copy was carried out in the same way as in Example I-1 or I-2 except that photosensitive members, toner particles, fine particles for preventing post-treatment agents from being embedded, and externally added post-treatment fine particles were used as shown in Table I-1.

Comparative Example I-1

A developer was prepared in the same way as in Example I-1 except that the titanium oxide fine particles were not fixed on the core particle surfaces. Then the same durability test with respect to copy as in Example I-1 was carried out. Results of the experiment are as shown in Table I-1. It is noted that the durability test with respect to copy was halted when 40,0000 copies were made with the result of extremely serious image flow.

Comparative Example I-2

A developer was prepared in the same way as in Comparative Example 1 except that the silica fine particles were externally added at an amount of 0.3 parts by weight. Then the same durability test with respect to copy as in Example I-1 was carried out. Results of the experiment are as shown in Table I-1. It is noted that the durability test with respect to copy was halted when 40,0000 copies were made with the result of extremely serious image flow.

Comparative Example I-3

A developer was prepared in the same way as in Comparative Example 1 except that 0.1 part by weight of silica fine particles and 0.5 parts by weight of titanium oxide fine particles (aerosil T805; made by Nippon Aerosil K.K.) were externally added. Then the same durability test with respect to copy as in Example I-1 was carried out. Results of the experiment are as shown in Table I-1.

TABLE I-1

| | Photo-sensitive member | Toner particle | Fine particles fixed: Type | Fine particles fixed: Amount of addition (parts by weight) | Externally added fine particles: Type | Externally added fine particles: Amount of addition (parts by weight) | Particle size (μcm) | Electrical resistance (Ωcm) | Image-flow test 200K | Image-flow test 400K | Image-flow test 600K |
|---|---|---|---|---|---|---|---|---|---|---|---|
| Ex.I-1 | 1 | B | $TiO_2$ | 0.5 | $SiO_2$ | 0.1 | 11.1 | $7\times10^{15}$ | ○ | Δ | Δ |
| Ex.I-2 | 2 | A | $SrTiO_3$ | 0.5 | $Al_2O_3$ | 0.1 | 9.7 | $5\times10^{15}$ | ○ | ○ | Δ |
| Ex.I-3 | 1 | B | $TiO_2$ | 0.5 | $Al_2O_3$ | 0.1 | 11.1 | $7\times10^{15}$ | ○ | ○ | Δ |
| Ex.I-4 | 1 | B | $BaTiO_3$ | 0.5 | $SiO_2$ | 0.1 | 11.1 | $6\times10^{15}$ | ○ | ○ | Δ |
| Ex.I-5 | 2 | B | $TiO_2$ | 1.0 | $SiO_2$ | 0.1 | 9.6 | $5\times10^{15}$ | ○ | ○ | ○ |
| Ex.I-6 | 2 | A | $TiO_2$ | 0.7 | $SiO_2$ | 0.3 | 9.6 | $5\times10^{15}$ | ○ | ○ | ○ |
| Ex.I-7 | 2 | A | $TiO_2$ | 1.0 | $SiO_2$ | 0.3 | 9.8 | $5\times10^{15}$ | ○ | ○ | ○ |
| Ex.I-8 | 1 | B | $TiO_2$ | 1.0 | $SiO_2$ | 0.1 | 11.1 | $7\times10^{15}$ | ○ | ○ | ○ |
| Ex.I-9 | 1 | B | $TiO_2$ | 2.0 | $SiO_2$ | 0.3 | 11.2 | $7\times10^{15}$ | ○ | ○ | ○ |
| Compar. Ex.I-1 | 1 | B | No addition | | $SiO_2$ | 0.1 | 11.0 | $7\times10^{15}$ | x | xx | — |
| Compar. Ex.I-2 | 1 | B | No addition | | $SiO_2$ | 0.3 | 11.2 | $6\times10^{15}$ | x | xx | — |
| Compar. Ex.I-3 | 1 | B | No addition | | $SiO_2$<br>$TiO_2$ | 0.1<br>0.5 | 11.2 | $7\times10^{15}$ | Δ | x | xx |

EXAMPLE II-1

To 100 parts by weight of the Toner Particle B was added 1.5 parts by weight of ferrite fine particles (volume-average particle size of primary particle: 0.3 μm, Aerosil T805; made by Nippon Aerosil K.K.) as magnetic fine particles. The mixture was processed by Henschel mixer (made by Mitsui Miike Kako K.K.) at 3,000 rpm for 5 min to fix the fine particles on the toner particle surfaces.

Further, 0.1 part by weight of hydrophobic silica fine particles (volume-average particle size of 0.016 μm, R972; made by Nippon Aerosil K.K.) was added to the resultant Toner Particle B and processed at 1,000 rpm for 1.5 min so as to be externally added to the Toner Particle B. The obtained toner was 11.2 μm in volume-average particle size.

A developer in which the resulting toner and the foregoing carrier were mixed at a mixing ratio of 5:95 was accommodated in the developing unit of a copying machine EP8600 (made by Minolta Camera K.K.) which had been so modified as to allow the aforementioned Photosensitive Member 1 to be used. Then a durability test with respect to copy of about 600,000 times was carried out.

In more detail, test charts were copied each 200,000 copies at room temperature and thereafter 10,000 sheets of paper were copied under a 30° C. temperature, 85% humidity environment. Then flow of copy images and fogs on white ground were evaluated.

The evaluation of copy image flow was ranked as follows:

| | |
|---|---|
| ○: | Image flow was not recognized. |
| Δ: | Slight image flow was recognized at character edge portions. |
| x: | Flow of characters was recognized on the whole. |
| xx: | Characters could not be discriminated. |

Copy images ranked equal to or higher than Δ are acceptable from the standpoint of practical use. Results of the evaluation are shown in Table II-1.

The evaluation of fogs on white ground was ranked as follows:

| | |
|---|---|
| ○: | Fogs were not recognized. |
| Δ: | Slight fogs were recognized but there is no problem about practical use. ID on the white ground was 1.5 or less. |
| x: | Fogs were recognized and ID on the white ground was more than 0.15. |
| xx: | Fogs were recognized and ID on the white ground was more than 0.20. |

Fogs ranked equal to or higher than Δ are acceptable from the standpoint of practical use. Results of the evaluation are shown in Table II-1.

EXAMPLE II-2

To 100 parts by weight of the Toner Particle A was added 2.0 parts by weight of iron fine particles (volume-average particle size of primary particles: 0.3 μm). The mixture was processed by Henschel mixer (made by Mitsui Miike Kako K.K.) at 3,500 rpm for 3 min to fix the fine particles on the toner particle surfaces.

Further, 0.1 part by weight of alumina fine particles (volume-average particle size of 0.02 μm, C604; made by Nippon Aerosil K.K.) was added to the resultant Toner Particle A and processed at 1,000 rpm for 1.5 min so as to be externally added to the toner particles. The resulting toner was 9.8 μm in volume-average particle size.

A developer in which the resulting toner and the foregoing carrier were mixed at a mixing ratio of 5:95 was accommodated in the developing unit of the copying machine EP8, 600 (made by Minolta Camera K.K.) which had been so modified as to allow the aforementioned Photosensitive Member 2 to be used. Then the same durability test with respect to copy as in Example II-1 was carried out. Results of the experiment are shown in Table II-1.

EXAMPLE II-3

A toner was obtained in a manner similar to Example II-1 except that 2.0 parts by weight of ferrite fine particles (volume-average particle size of primary particles: 0.3 μm) as magnetic fine particles and 0.3 parts by weight of alumina fine particles (volume-average particle size of 0.02 μm, C604, made by Nippon Aerosil K.K.) as externally added post-treatment fine particles were used on the basis of 100 parts by weight of the Toner Particle B.

The obtained toner had a volume-average particle size of 11.2 μm. The durability test with respect to copy was carried out in the same way as in Example II-1. The results are shown in Table II-1.

EXAMPLE II-4

A toner was obtained in a manner similar to Example II-2 except that 3.0 parts by weight of ferrite fine particles (volume-average particle size of primary particles: 0.3 μm) as magnetic fine particles and 0.1 part by weight of hydrophobic silica fine particles (volume-average particle size of 0.016 μm, R972, made by Nippon Aerosil K.K.) as externally added post-treatment fine particles were used on the basis of 100 parts by weight of the Toner Particle A.

The obtained toner had a volume-average particle size of 9.7 μm. The durability test with respect to copy was carried out in the same way as in Example II-2. The results are shown in Table II-1.

EXAMPLE II-5

A toner was obtained in a manner similar to Example II-2 except that 2.0 parts by weight of magnetite fine particles (volume-average particle size of primary particles: 0.15 μm) as magnetic fine particles and 0.1 part by weight of hydrophobic silica fine particles (volume-average particle size of 0.012 μm, R974, made by Nippon Aerosil K.K.) as externally added post-treatment fine particles were used on the basis of 100 parts by weight of the Toner Particle A.

The obtained toner had a volume-average particle size of 9.7 μm. The durability test with respect to copy was carried out in the same way as in Example II-2. The results are shown in Table II-1.

EXAMPLE II-6

A toner was obtained in a manner similar to Example II-1 except that 3.0 parts by weight of magnetite fine particles (volume-average particle size of primary particles: 0.15 μm) as magnetic fine particles and 0.3 parts by weight of hydrophobic silica fine particles (volume-average particle size of 0.012 μm, R974, made by Nippon Aerosil K.K.) as externally added post-treatment fine particles were used on the basis of 100 parts by weight of the Toner Particle B.

The obtained toner had a volume-average particle size of 11.2 μm. The durability test with respect to copy was carried out in the same way as in Example II-1. The results are shown in Table II-1.

EXAMPLE II-7

A toner was obtained in a manner similar to Example II-1 except that 3.0 parts by weight of ferrite fine particles (volume-average particle size of primary particles: 0.3 μm) as magnetic fine particles and 0.3 parts by weight of hydrophobic titanium dioxide fine particles (volume-average particle size of 0.04 μm, MT-400BS, made by Teika K.K.) as externally added post-treatment fine particles were used on the basis of 100 parts by weight of the Toner Particle B.

The obtained toner had a volume-average particle size of 11.1 μm. The durability test with respect to copy was carried out in the same way as in Example II-1. The results are shown in Table II-1.

EXAMPLE II-8

A toner was obtained in a manner similar to Example II-2 except that 5.0 parts by weight of magnetite fine particles (volume-average particle size of primary particles: 0.15 μm) as magnetic fine particles and 0.1 part by weight of hydrophobic silica fine particles (volume-average particle size of 0.016 μm, R972, made by Nippon Aerosil K.K.) as externally added post-treatment fine particles were used on the basis of 100 parts by weight of the Toner Particle A.

The obtained toner had a volume-average particle size of 9.8 μm. The durability test with respect to copy was carried out in the same way as in Example II-2. The results are shown in Table II-1.

EXAMPLE II-9

A toner was obtained in a manner similar to Example II-1 except that 7.0 parts by weight of ferrite fine particles (volume-average particle size of primary particles: 0.3 μm) as magnetic fine particles and 0.3 parts by weight of hydrophobic silica fine particles (volume-average particle size of 0.016 μm, R972, made by Nippon Aerosil K.K.) as externally added post-treatment fine particles were used on the basis of 100 parts by weight of the Toner Particle B.

The obtained toner had a volume-average particle size of 11.2 μm. The durability test with respect to copy was carried out in the same way as in Example II-1. The results are shown in Table II-1.

Comparative Example II-1

A toner was prepared in the same way as in Example II-1 except that the magnetic fine particles were not fixed on the toner particle surfaces. The obtained toner had a volume-average particle size of 11.0 μm. Then the same durability test with respect to copy as in Example II-1 was carried out. Results of the experiment are shown in Table II-1.

Comparative Example II-2

A toner was prepared in the same way as in Comparative Example II-1 except that the silica fine particles were externally added at an amount of 0.3 parts by weight. The obtained toner had a volume-average particle size of 11.2 μm. Then the same durability test with respect to copy as in Example II-1 was carried out. Results of the experiment are shown in Table II-1. It is noted that the durability test with respect to copy was halted when 40,0000 copies were made with the result of extremely serious image flow and fogs.

Comparative Example II-3

A toner was prepared in the same way as in Comparative Example II-1 except that 0.1 part by weight of silica fine particles and 2.0 parts by weight of ferrite fine particles (volume-average particle size of primary particles: 0.3 μm) were externally added. The obtained toner had a volume-average particle size of 11.3 μm. Then the same durability test with respect to copy as in Example II-1 was carried out. Results of the experiment are as shown in Table II-1.

Comparative Example II-4

A toner was prepared in the same way as in Example II-4 except that no fine particles were externally added. The obtained toner had a volume-average particle size of 9.7 μm. Then the same durability test with respect to copy as in Example II-2 was carried out. Results of the experiment are as shown in Table II-1.

TABLE II-1

| | Photo-sensitive | Image-flow | | | Fogs on white ground | | |
|---|---|---|---|---|---|---|---|
| | member | 200K | 400K | 600K | 200K | 400K | 600K |
| Ex. II-1 | 1 | ○ | Δ | Δ | ○ | ○ | Δ |
| Ex. II-2 | 2 | ○ | ○ | Δ | ○ | ○ | ○ |

TABLE II-1-continued

| | Photo-sensitive | Image-flow | | | Fogs on white ground | | |
|---|---|---|---|---|---|---|---|
| | member | 200K | 400K | 600K | 200K | 400K | 600K |
| Ex. II-3 | 1 | ○ | ○ | Δ | ○ | ○ | Δ |
| Ex. II-4 | 2 | ○ | ○ | Δ | ○ | ○ | Δ |
| Ex. II-5 | 2 | ○ | ○ | ○ | ○ | ○ | Δ |
| Ex. II-6 | 1 | ○ | ○ | ○ | ○ | ○ | ○ |
| Ex. II-7 | 1 | ○ | ○ | Δ | ○ | ○ | ○ |
| Ex. II-8 | 2 | ○ | ○ | ○ | ○ | ○ | ○ |
| Ex. II-9 | 1 | ○ | ○ | ○ | ○ | ○ | ○ |
| Compar. Ex. II-1 | 1 | x | xx | xx | ○ | Δ | x |
| Compar. Ex. II-2 | 1 | x | xx | — | ○ | x | — |
| Compar. Ex. II-3 | 1 | Δ | x | xx | ○ | Δ | x |
| Compar. Ex. II-4 | 2 | ○ | x | x | ○ | ○ | ○ |

EXAMPLE III-1

To 100 parts by weight of the Toner Particle B was added 0.5 parts by weight of hydrophobic silica fine particles (volume-average particle size of primary particle: 0.016 μm, T972; made by Nippon Aerosil K.K.). The mixture was processed by Henschel mixer (made by Mitsui Miike Kako K.K.) at 3,000 rpm for 5 min to fix the fine particles on the toner particle surfaces.

Further, 0.1 part by weight of hydrophobic silica fine particles (volume-average particle size of 0.016 μm, R972; made by Nippon Aerosil K.K.) was added to the resultant Toner Particle B and processed at 1,000 rpm for 1.5 min so as to be externally added to the Toner Particle B. The obtained toner was 11.1 μm in volume-average particle size and $6\times10^{15}$ Ωcm in electrical resistance.

EXAMPLE III-2

To 100 parts by weight of the Toner Particle A was added 0.7 parts by weight of silica fine particles (volume-average particle size of primary particle: 0.04 μm, OX50, made by Nippon Aerosil K.K.). The mixture was processed by Henschel mixer (made by Mitsui Miike Kako K.K.) at 3,500 rpm for 3 min to fix the fine particles on the toner particle surfaces.

Further, 0.1 part by weight of alumina fine particles (C604; made by Nippon Aerosil K.K.) was added to the resultant Toner Particle B and processed at 1,000 rpm for 1.5 min so as to be externally added to the toner particles. The resulting toner was 9.7 μm in volume-average particle size and $5\times10^{15}$ Ωcm in electrical resistance.

EXAMPLE III-3

A toner was obtained in a manner similar to Example III-1 except that 0.7 parts by weight of hydrophobic silica fine particles (volume-average particle size: 0.016 μm), and 0.1 part by weight of alumina fine particles (volume-average particle size of 0.02 μm, C604, made by Nippon Aerosil K.K.) as externally added post-treatment fine particles were used on the basis of 100 parts by weight of the Toner Particle B.

The obtained toner had a volume-average particle size of 11.2 μm and an electrical resistance of $6\times10^{15}$ Ωcm.

EXAMPLE III-4

A toner was obtained in a manner similar to Example III-2 except that 0.7 parts by weight of silica fine particles (volume-average particle size of primary particle: 0.04 μm, OX50, made by Nippon Aerosil K.K.), and 0.1 part by weight of hydrophobic silica fine particles (volume-average particle size of 0.016 μm, R972, made by Nippon Aerosil K.K.) as externally added post-treatment fine particles were used on the basis of 100 parts by weight of the Toner Particle A.

The obtained toner had a volume-average particle size of 9.6 μm and an electrical resistance of $6\times10^{15}$ Ωcm.

EXAMPLE III-5

A toner was obtained in a manner similar to Example III-1 except that 1.0 part by weight of silica fine particles (volume-average particle size of primary particle: 0.04 μm, OX50, made by Nippon Aerosil K.K.), and 0.1 part by weight of hydrophobic silica fine particles (volume-average particle size of 0.016 μm, R972, made by Nippon Aerosil K.K.) as externally added post-treatment fine particles were used on the basis of 100 parts by weight of the Toner Particle B.

The obtained toner had a volume-average particle size of 11.4 μm and an electrical resistance of $4\times10^{15}$ Ωcm.

EXAMPLE III-6

A toner was obtained in a manner similar to Example III-2 except that 1.0 part by weight of hydrophobic silica fine particles (volume-average particle size: 0.016 μm, R972, made by Nippon Aerosil K.K.), and 0.3 parts by weight of hydrophobic silica fine particles (volume-average particle size of 0.016 μm, R972, made by Nippon Aerosil K.K.) as externally added post-treatment fine particles were used on the basis of 100 parts by weight of the Toner Particle A.

The obtained toner had a volume-average particle size of 9.6 μm and an electrical resistance of $6\times10^{15}$ Ωcm.

EXAMPLE III-7

A toner was obtained in a manner similar to Example III-1 except that 1.5 parts by weight of hydrophobic silica fine particles (volume-average particle size of primary particle: 0.014 μm, R202, made by Nippon Aerosil K.K.), and 0.3 parts by weight of hydrophobic silica fine particles (volume-average particle size of 0.016 μm, R972, made by Nippon Aerosil K.K.) as externally added post-treatment fine particles were used on the basis of 100 parts by weight of the Toner Particle B.

The obtained toner had a volume-average particle size of 11.3 μm and an electrical resistance of $5\times10^{15}$ Ωcm.

EXAMPLE III-8

A toner was obtained in a manner similar to Example III-2 except that 1.5 parts by weight of hydrophobic silica fine particles (volume-average particle size of primary particle: 0.01 μm, R805, made by Nippon Aerosil K.K.), and 0.1 part by weight of hydrophobic silica fine particles (volume-average particle size of 0.016 μm, R972, made by Nippon Aerosil K.K.) as externally added post-treatment fine particles were used on the basis of 100 parts by weight of the Toner Particle A.

The obtained toner had a volume-average particle size of 9.7 μm and an electrical resistance of $6\times10^{15}$ Ωcm.

EXAMPLE III-9

A toner was obtained in a manner similar to Example III-2 except that 2.0 parts by weight of hydrophobic silica fine particles (volume-average particle size: 0.016 μm, R972, made by Nippon Aerosil K.K.), and 0.3 parts by weight of hydrophobic silica fine particles (volume-average particle size of 0.016 μm, R972, made by Nippon Aerosil K.K.) as externally added post-treatment fine particles were used on the basis of 100 parts by weight of the Toner Particle A.

The obtained toner had a volume-average particle size of 9.7 μm and an electrical resistance of $6\times10^{15}$ Ωcm.

Comparative Example III-1

A toner was prepared in a manner similar to Example III-2, except that silica fine particles were not fixed on the surfaces of toner particles.

The obtained toner had a volume-average particle size of 9.8 μm and an electrical resistance of $7\times10^{15}$ Ωcm.

Comparative Example III-2

A toner was prepared in the same way as in Comparative Example III-1 except that the silica fine particles were externally added at an amount of 0.3 parts by weight.

The obtained toner had a volume-average particle size of 9.7 μm and an electrical resistance of $5\times10^{15}$ Ωcm.

Comparative Example III-3

A toner was prepared in the same way as in Comparative Example III-1 except that 0.3 parts by weight of hydrophobic silica fine particles (volume-average particle size of 0.016 μm, R972, made by Nippon Aerosil K.K.) and 1.0 part by weight of silica fine particles (volume-average particle size: 0.04 μm, OX50, made by Nippon Aerosil K.K.) were externally added.

The obtained toner had a volume-average particle size of 9.8 μm and an electrical resistance of $7\times10^{15}$ Ωcm.

Comparative Example III-4

A toner was prepared in the same way as in Example III-4 except that no fine particles were externally added.

The obtained toner had a volume-average particle size of 9.7 μm and an electrical resistance of $7\times10^{15}$ Ωcm.

A developer in which the resulting each toner and the foregoing carrier were mixed at a mixing ratio of 5:95 was accommodated in the developing unit of a copying machine EP8600 (made by Minolta Camera K.K.) which had been so modified as to allow the aforementioned Photosensitive Member 1 and Photosensitive Member 2 to be used. Then a durability test with respect to copy of about 600,000 times was carried out.

In more detail, test charts were copied each 200,000 copies at room temperature and thereafter 10,000 sheets of paper were copied under a 30° C. temperature, 85% humidity environment. Then flow of copy images was evaluated.

The evaluation of copy image flow was ranked as follows:

| | |
|---|---|
| ○: | Image flow was not recognized. |
| Δ: | Slight image flow was recognized at character edge portions. |
| x: | Flow of characters was recognized on the whole. |
| xx: | Characters could not be discriminated. |

Copy images ranked equal to or higher than Δ are acceptable from the standpoint of practical use. Results of the evaluation are shown in Table III-1.

Toner fusion properties were evaluated by the following accelerated test.

The Photosensitive Member 1 was used. Negatively chargeable Toner B was mixed with the aforementioned carrier at a mixing ratio of 5:95 to give a developer. The photosensitive member was not electrically charged but a developing bias-voltage of +400 V was applied. Under such conditions, the remodeled copying machine EP8,600 was driven for 2 hours without providing paper. At this time, as the developing bias voltage was applied in such a way as toner particles were attracted to the developing machine, not toner particles but positively charged carrier particles were developed and adhered to the surface of the photosensitive member. The adhered carrier particles were embedded into the surface of the photosensitive member by mechanical stresses caused by a cleaner blade or a developing apparatus.

Then the Photosensitive Member 2 was used in combination with the positively chargeable Toner A. Carrier was adhered to the photosensitive member in the same manner as above mentioned except that a developing bias-voltage of −400 V was applied.

The respective photosensitive members with the carrier adhered thereto were used. A developer containing the above obtained each toner and the carrier at a mixing ratio of 5:95 was put into the remodeled copying machine EP8,600. The copying machine was driven for 40 hours without providing paper while a developing bias-voltage of 150 V whose polarity was the same as that of toner chargeability was applied. Under such conditions, toner particles were developed on the photosensitive member by virtue of the developing bias.

The surface of the photosensitive member was observed visually and copy images were evaluated every 10 hours. The evaluation was done whether toner fusion was generated. The results were shown in Table III-1. In the table the symbol "o" means that the toner fusion was not recognized. The symbol "x" means that the toner fusion was observed.

In Comparative Examples III-1 and 1II-2, after 400,000 times of copy, image flow became remarkable, the durability test with respect to copy was stopped. Further charging amount of toner was lowered after 400,000 times of copy.

EXAMPLE IV-1

To 100 parts by weight of the Toner Particle A was added 0.7 parts by weight of fine resin-particles of poly(methyl methacrylate) (volume-average particle size: 0.15 μm, Rockwell hardness: 110) as organic fine particles. The mixture was processed by Henschel mixer (made by Mitsui Miike Kako K.K.) at 3,000 rpm for 5 min to fix the fine particles on the toner particle surfaces.

Further, 0.1 part by weight of hydrophobic silica fine particles (volume-average particle size: 0.016 μm, R972; made by Nippon Aerosil K.K.) was added to the resultant Toner Particle A and processed at 1,000 rpm for 1.5 min so as to be externally added to the Toner Particle A. The obtained toner was 9.7 μm in volume-average particle size and $5\times10^{15}$ Ωcm in electrical resistance.

A developer in which the resulting toner and the foregoing carrier were mixed at a mixing ratio of 5:95 was accommodated in the developing unit of a copying machine EP8600 (made by Minolta Camera K.K.) which had been so modified as to allow the aforementioned Photosensitive Member 2 to be used. Then a durability test with respect to copy of about 600,000 times was carried out.

In more detail, test charts were copied each 200,000 copies at room temperature and thereafter 10,000 sheets of paper were copied under a 30° C. temperature, 85% humidity environment. Then copy images were evaluated on image flow.

The evaluation was ranked as follows:

| | |
|---|---|
| ○: | Image flow was not recognized. |
| Δ: | Slight image flow was recognized at character edge portions. |
| X: | Flow of characters was recognized on the whole. |

TABLE III-1

| | Photo-sensitive member | Image-flow | | | Toner-fusion | | | |
|---|---|---|---|---|---|---|---|---|
| | | 200K | 400K | 600K | 10 hours | 20 hours | 30 hours | 40 hours |
| Ex.III-1 | 1 | ○ | ○ | Δ | ○ | ○ | ○ | ○ |
| Ex.III-2 | 2 | ○ | ○ | ○ | ○ | ○ | ○ | ○ |
| Ex.III-3 | 1 | ○ | ○ | ○ | ○ | ○ | ○ | ○ |
| Ex.III-4 | 2 | ○ | ○ | ○ | ○ | ○ | ○ | ○ |
| Ex.III-5 | 1 | ○ | ○ | ○ | ○ | ○ | ○ | ○ |
| Ex.III-6 | 2 | ○ | ○ | ○ | ○ | ○ | ○ | ○ |
| Ex.III-7 | 1 | ○ | ○ | ○ | ○ | ○ | ○ | ○ |
| Ex.III-8 | 2 | ○ | ○ | ○ | ○ | ○ | ○ | ○ |
| Ex.III-9 | 2 | ○ | ○ | ○ | ○ | ○ | ○ | ○ |
| Compar. Ex.III-1 | 2 | X | XX | — | X | X | X | X |
| Compar. Ex.III-2 | 2 | X | XX | — | X | X | X | X |
| Compar. Ex.III-3 | 2 | ○ | Δ | XX | ○ | X | X | X |
| Compar. Ex.III-4 | 2 | ○ | Δ | XX | ○ | ○ | ○ | ○ |

-continued

| | |
|---|---|
| XX: | Characters could not be discriminated. |

Copy images ranked equal to or higher than Δ are acceptable from the standpoint of practical use. Results of the evaluation are shown in Table IV-1.

In the durability test with respect to copy, it was observed every 10,000 times of copy if toner accumulation occurred on the backside of the cleaning blade.

In Table IV-1, the symbol "x" means that toner accumulation was observed on the backside of the cleaning blade before 300,000 times of copy, which is a life time of the cleaning blade itself. The symbol "o" means that there was no problem about practical use even after 300,000 times of copy.

EXAMPLE IV-2

To 100 parts by weight of the Toner Particle A was added 1.0 part by weight of aluminum stearate fine particles (volume-average particle size: 0.2 μm, Rockwell hardness: 92) as organic fine particles. The mixture was processed by Henschel mixer (made by Mitsui Miike Kako K.K.) at 3,500 rpm for 5 min to fix the fine particles on the toner particle surfaces.

Further, 0.1 part by weight of hydrophobic titanium dioxide fine particles (volume-average particle size of 0.05 μm, T805; made by Nippon Aerosil K.K.) was added to the resultant Toner Particle A and processed at 1,000 rpm for 1.5 min so as to be externally added to the toner particles. The resulting toner was 9.8 μm in volume-average particle size and $6\times10^{15}$ Ωcm in electrical resistance.

Then the same durability test with respect to copy as in Example IV-1 was carried out. Results of the experiment are shown in Table IV-1.

EXAMPLE IV-3

A toner was obtained in a manner similar to Example IV-1 except that 0.7 parts by weight of fine resin-particles of poly(methyl methacrylate) (volume-average particle size: 0.15 μm, Rockwell hardness: 110) as organic fine particles and 0.3 parts by weight of hydrophobic alumina fine particles (volume-average particle size of 0.02 μm, C604, made by Nippon Aerosil K.K.) as externally added post-treatment fine particles were used on the basis of 100 parts by weight of the Toner Particle B.

The obtained toner had a volume-average particle size of 11.3 μm and an electrical resistance of $5\times10^{15}$ Ωcm.

A developer in which the resulting toner and the foregoing carrier were mixed at a mixing ratio of 5:95 was accommodated in the developing unit of the copying machine EP8, 600 (made by Minolta Camera K.K.) which had been so modified as to allow the aforementioned Photosensitive Member 1 to be used. Then the same durability test with respect to copy as in Example IV-1 was carried out. Results of the experiment are shown in Table IV-1.

EXAMPLE IV-4

A toner was obtained in a manner similar to Example IV-3 except that 0.7 parts by weight of fine resin-particles of poly(methyl methacrylate) (volume-average particle size: 0.15 μm, Rockwell hardness: 110) as organic fine particles and 0.3 parts by weight of hydrophobic silica fine particles (volume-average particle size of 0.016 μm, R972, made by Nippon Aerosil K.K.) as externally added post-treatment fine particles were used on the basis of 100 parts by weight of the Toner Particle B.

The obtained toner had a volume-average particle size of 11.2 μm and an electrical resistance of $3\times10^{15}$ Ωcm.

Then the same durability test with respect to copy as in Example IV-3 was carried out. Results of the experiment are shown in Table IV-1.

EXAMPLE IV-5

A toner was obtained in a manner similar to Example IV-3 except that 1.0 part by weight of fine resin-particles of aluminum stearate (volume-average particle size: 0.2 μm, Rockwell hardness: 92) as organic fine particles and 0.1 part by weight of hydrophobic titanium dioxide fine particles (volume-average particle size of 0.05 μm, T805, made by Nippon Aerosil K.K.) as externally added post-treatment fine particles were used on the basis of 100 parts by weight of the Toner Particle B.

The obtained toner had a volume-average particle size of 11.3 μm and an electrical resistance of $5\times10^{15}$ Ωcm.

Then the same durability test with respect to copy as in Example IV-3 was carried out. Results of the experiment are shown in Table IV-1.

EXAMPLE IV-6

A toner was obtained in a manner similar to Example IV-2 except that 1.0 part by weight of fine resin-particles of polycarbonate (volume-average particle size: 0.3 μm, Rockwell hardness: 115) as organic fine particles and 0.3 parts by weight of hydrophobic silica fine particles (volume-average particle size of 0.016 μm, R972, made by Nippon Aerosil K.K.) as externally added post-treatment fine particles were used on the basis of 100 parts by weight of the Toner Particle A.

The obtained toner had a volume-average particle size of 9.9 μm and an electrical resistance of $6\times10^{15}$ Ωcm.

Then the same durability test with respect to copy as in Example IV-2 was carried out. Results of the experiment are shown in Table IV-1.

EXAMPLE IV-7

A toner was obtained in a manner similar to Example IV-2 except that 1.5 parts by weight of fine resin-particles of poly(methyl methacrylate) (volume-average particle size: 0.15 μm, Rockwell hardness: 110) as organic fine particles and 0.1 part by weight of hydrophobic silica fine particles (volume-average particle size of 0.016 μm, R972, made by Nippon Aerosil K.K.) as externally added post-treatment fine particles were used on the basis of 100 parts by weight of the Toner Particle A.

The obtained toner had a volume-average particle size of 9.7 μm and an electrical resistance of $5\times10^{15}$ Ωcm.

Then the same durability test with respect to copy as in Example IV-2 was carried out. Results of the experiment are shown in Table IV-1.

EXAMPLE IV-8

A toner was obtained in a manner similar to Example IV-3 except that 1.5 parts by weight of fine resin-particles of melamine resin (volume-average particle size: 0.3 μm, Rockwell hardness: 130) as organic fine particles and 0.1 part by weight of hydrophobic silica fine particles (volume-average particle size of 0.016 μm, R972, made by Nippon Aerosil K.K.) as externally added post-treatment fine particles were used on the basis of 100 parts by weight of the Toner Particle B.

The obtained toner had a volume-average particle size of 11.3 μm and an electrical resistance of $3\times10^{15}$ Ωcm.

Then the same durability test with respect to copy as in Example IV-3 was carried out. Results of the experiment are shown in Table IV-1.

EXAMPLE IV-9

A toner was obtained in a manner similar to Example IV-2 except that 2.0 parts by weight of fine resin-particles of poly(methyl methacrylate) (volume-average particle size: 0.15 μm, Rockwell hardness: 110) as organic fine particles and 0.1 part by weight of hydrophobic silica fine particles (volume-average particle size of 0.016 μm, R972, made by Nippon Aerosil K.K.) as externally added post-treatment fine particles were used on the basis of 100 parts by weight of the Toner Particle A.

The obtained toner had a volume-average particle size of 9.7 μm and an electrical resistance of $5\times10^{15}$ Ωcm.

Then the same durability test with respect to copy as in Example IV-2 was carried out. Results of the experiment are shown in Table IV-1.

Comparative Example IV-1

A toner was prepared in the same way as in Example IV-1 except that the organic fine particles were not fixed on the toner particle surfaces.

The obtained toner had a volume-average particle size of 9.8 μm and an electrical resistance of $7\times10^{15}$ Ωcm.

Then the same durability test with respect to copy as in Example IV-1 was carried out. Results of the experiment are shown in Table IV-1.

It is noted that the durability test with respect to copy was halted when 40,0000 copies were made with the result of extremely serious image flow.

Further toner accumulation at the backside of the cleaning blade occurred after 190,000 times of copy but before 300,000 times of copy (exchanging time of the blade).

Comparative Example IV-2

A toner was prepared in the same way as in Comparative Example IV-1 except that the silica fine particles were externally added at an amount of 0.3 parts by weight. The obtained toner had a volume-average particle size of 9.7 μm and an electrical resistance of $6\times10^{15}$ Ωcm.

Then the same durability test with respect to copy as in Example IV-1 was carried out. Results of the experiment are shown in Table IV-1.

It is noted that the durability test with respect to copy was halted when 40,0000 copies were made with the result of extremely serious image flow and fogs.

Further toner accumulation at the backside of the cleaning blade occurred after 220,000 times of copy but before 300,000 times of copy (exchanging time of the blade).

Comparative Example IV-3

A toner was prepared in the same way as in Comparative Example IV-1 except that 0.1 part by weight of hydrophobic silica fine particles (volume-average particle size of 0.016 μm, R972, made by Nippon Aerosil K.K.) and 1.5 parts by weight of fine resin-particles of poly(methyl methacrylate) (volume-average particle size: 0.15 μm) were externally added. The obtained toner had a volume-average particle size of 9.7 μm and an electrical resistance of $4\times10^{15}$ Ωcm.

Then the same durability test with respect to copy as in Example IV-1 was carried out. Results of the experiment are as shown in Table IV-1.

It is noted that the durability test with respect to copy was halted when 40,0000 copies were made with the result of extremely serious image flow.

Comparative Example IV-4

A toner was prepared in the same way as in Example IV-1 except that no fine particles were externally added. The obtained toner had a volume-average particle size of 9.8 μm and an electrical resistance of $4\times10^{15}$ Ωcm.

Then the same durability test with respect to copy as in Example IV-1 was carried out. Results of the experiment are as shown in Table IV-1.

TABLE IV-1

| | Photo-sensitive member | Image-flow 200K | 400K | 600K | Cleaning properties |
|---|---|---|---|---|---|
| Ex. IV-1 | 2 | ○ | Δ | Δ | ○ |
| Ex. IV-2 | 2 | ○ | ○ | Δ | ○ |
| Ex. IV-3 | 1 | ○ | ○ | Δ | ○ |
| Ex. IV-4 | 1 | ○ | ○ | Δ | ○ |
| Ex. IV-5 | 1 | ○ | ○ | ○ | ○ |
| Ex. IV-6 | 2 | ○ | ○ | ○ | ○ |
| Ex. IV-7 | 2 | ○ | ○ | ○ | ○ |
| Ex. IV-8 | 1 | ○ | ○ | ○ | ○ |
| Ex. IV-9 | 2 | ○ | ○ | ○ | ○ |
| Compar. Ex. IV-1 | 2 | X | XX | — | X |
| Compar. Ex. IV-2 | 2 | X | XX | — | X |
| Compar. Ex. IV-3 | 2 | X | XX | — | ○ |
| Compar. Ex. IV-4 | 2 | ○ | X | XX | ○ |

Positively Chargeable Toner

PRODUCTION OF TONER PARTICLE A'

The following materials were well mixed and then fusion-mixed by a twin-screw extrusion kneader, followed by cooling:

- Styrene-acrylic copolymer resin 100 parts by weight (Mn: 5,400, Mw: 156,000, Tg: 60° C., Tm: 120° C.)
- Colorant: carbon black 10 parts by weight (Raven 1,250; made by Columbia Carbon K.K.)
- Offset inhibitor: wax 3 parts by weight (Viscol 550P; made by Sanyo Kasei Kogyo K.K.)
- Charge controlling agent: Nigrosine dye (Nigrosine base EX; made by Orient Kagaku Kogyo K.K.) 5 parts by weight The cooled product was roughly pulverized, and then finely pulverized by a jet mill, and further classified by an air classifier. Thus Toner Particle A' was obtained. The resulting Toner Particle A' was 9.5 μm in volume-average particle size.

Toner Particles C and D were further produced as follows.

Production of Toner Particle C

Toner Particle A was mixed with alumina fine particles (BET specific surface area of 30 $m^2/g$, volume-average particle size of 0.1 μm) at an alumina content of 2% by weight. The mixture was processed by Henschel mixer at 3,000 rpm for 5 min to fix the fine particles on the toner particle surfaces to give Toner Particle C.

Production of Toner Particle D

Toner Particle A was mixed with alumina fine particles which were subjected to a hydrophobic treatment with dimethyldichlorosilane (BET specific surface area of 60 $m^2/g$, volume-average particle size of 0.05 μm) at an alumina content of 2% by weight. The mixture was processed by Henschel mixer at 3,000 rpm for 5 min to fix the fine particles on the toner particle surfaces to give Toner Particle D.

Negatively Chargeable Toner

PRODUCTION OF TONER PARTICLE B'

The following materials were well mixed and then fusion-mixed by a twin-screw extrusion kneader, followed by cooling:

- Styrene acrylic copolymer resin 100 parts by weight (Mn: 5,400, Mw: 156,000, Tg: 60° C., Tm: 120° C.)
- Colorant: carbon black 10 parts by weight (Raven 1250; made by Columbia Carbon K.K.)
- Offset inhibitor: wax 3 parts by weight (Viscol 550P; made by Sanyo Kasei Kogyo K.K.)
- Charge controlling agent: 3 parts by weight chrome complex salt type azo dye (S-34; made by Orient Kagaku Kogyo K.K.)

The cooled product was roughly pulverized, and then finely pulverized by a jet mill, and further classified by an air classifier. Thus Toner Particle B' was obtained. The resulting Toner Particles B' was 9.5 μm in volume-average particle size.

Toner Particles E and F were further produced as follows.

Production of Toner Particle E

Toner Particle B was mixed with alumina fine particles (BET specific surface area of 30 $m^2/g$, volume-average particle size of 0.1 μm) at an alumina content of 2% by weight. The mixture was processed by Henschel mixer at 3,000 rpm for 5 min to fix the fine particles on the toner particle surfaces to give Toner Particle E.

Production of Toner Particle F

Toner Particle B was mixed with alumina fine particles which were subjected to a hydrophobic treatment with dimethyldichlorosilane (BET specific surface area of 60 $m^2/g$, volume-average particle size of 0.05 μm) at an alumina content of 2% by weight. The mixture was processed by Henschel mixer at 3,000 rpm for 5 min to fix the fine particles on the toner particle surfaces to give Toner Particle F.

EXAMPLE V-1

Toner Particle C was mixed with hydrophobic silica fine particles (BET specific surface area of 180 $m^2/g$, volume-average particle size of 0.012 μm, R974, made by Nippon Aerosil K.K.) at a silica content of 0.1% by weight. The mixture was processed by Henschel mixer (made by Mitsui Miike Kako K.K.) at 1,000 rpm for 1.5 min to add the fine particles externally to the toner particle surfaces to give Toner V-1.

EXAMPLE V-2

Toner Particles D and F were mixed respectively with hydrophobic silica fine particles (BET specific surface area of 180 $m^2/g$, volume-average particle size of 0.012 μm, R974, made by Nippon Aerosil K.K.) at a silica content of 0.2% by weight. The mixture was processed by Henschel mixer (made by Mitsui Miike Kako K.K.) at 1,000 rpm for 1.5 min to add the fine particles externally to the toner particle surfaces to give Toners V-2 and V-3 respectively.

EXAMPLE V-3

Toner Particle C was mixed with hydrophobic silica fine particles (BET specific surface area of 180 $m^2/g$, volume-average particle size of 0.012 μm, R974, made by Nippon Aerosil K.K.) at a silica content of 0.2% by weight. The mixture was processed by Henschel mixer (made by Mitsui Miike Kako K.K.) at 1,000 rpm for 1.5 min to add the fine particles externally to the toner particle surfaces to give Toner V-4.

EXAMPLE V-4

Toner Particles C and E were mixed respectively with hydrophobic silica fine particles (BET specific surface area of 300 $m^2/g$, volume-average particle size of 0.007 μm, 300CF, made by Nippon Aerosil K.K.) at a silica content of 0.15% by weight. The mixture was processed by Henschel mixer (made by Mitsui Miike Kako K.K.) at 1,000 rpm for 1.5 min to add the fine particles externally to the toner particle surfaces to give Toners V-5 and V-6 respectively.

EXAMPLE V-5

Toner Particle C was mixed with hydrophobic silica fine particles (BET specific surface area of 120 $m^2/g$, volume-average particle size of 0.012 μm, H-2000, made by HDK K.K.) at a silica content of 0.3% by weight. The mixture was processed by Henschel mixer (made by Mitsui Miike Kako K.K.) at 1,000 rpm for 1.5 min to add the fine particles externally to the toner particle surfaces to give Toner V-7.

EXAMPLE V-6

Toner Particles C and E were mixed respectively with titanium dioxide fine particles which were subjected to a hydrophobic treatment with dimethylchlorosilane (BET specific surface area of 50 $m^2/g$, volume-average particle size of 0.1 μm) at a titanium dioxide content of 0.1% by weight. The mixture was processed by Henschel mixer (made by Mitsui Miike Kako K.K.) at 1,000 rpm for 1.5 min to add the fine particles externally to the toner particle surfaces to give Toners V-8 and V-9 respectively.

EXAMPLE V-7

Toner Particles D was mixed with alumina fine particles which were subjected to a hydrophobic treatment with dimethylchlorosilane (BET specific surface area of 30 $m^2/g$, volume-average particle size of 0.2 μm) at an alumina content of 0.1% by weight. The mixture was processed by Henschel mixer (made by Mitsui Miike Kako K.K.) at 1,000 rpm for 1.5 min to add the fine particles externally to the toner particle surfaces to give Toners V-10.

Comparative Example V-1

Fine particles were not externally added to Toner Particle C and Toner Particle E to give Toner V-11 and Toner V-12 respectively.

Comparative Example V-2

Toner Particles A' and B' were mixed respectively with hydrophobic silica fine particles (BET specific surface area of 180 $m^2/g$, volume-average particle size of 0.012 μm, R974, made by Nippon Aerosil K.K.) at a silica dioxide content of 0.1% by weight. The mixture was processed by Henschel mixer (made by Mitsui Miike Kako K.K.) at 1,000 rpm for 1.5 min to add the fine particles externally to the toner particle surfaces to give Toners V-13 and V-14 respectively.

Comparative Example V-3

Toner Particles C and E were mixed respectively with hydrophobic silica fine particles which were subjected to a hydrophobic treatment with dimethylchlorosilane (BET specific surface area of 380 $m^2/g$, volume-average particle size of 0.007 μm, 380, made by Nippon Aerosil K.K.) at a silica dioxide content of 0.3% by weight. The mixture was processed by Henschel mixer (made by Mitsui Miike Kako K.K.) at 1,000 rpm for 1.5 min to add the fine particles externally to the toner particle surfaces to give Toners V-15 and V-16 respectively.

EVALUATION

A developer containing the toner and carrier shown in Table V-1 at a mixing ratio of 5:95, and the photosensitive member shown in Table V-1 were installed in a copying machine EP8600 (made by Minolta Camera K.K.) remodeled for both negative and positive charging. Durability test with respect to copy of 600,000 times of copy was carried out under a constant temperature of the photosensitive member by a heater for the photosensitive member. Dot-like noises and image-flow were evaluated.

With respect to the dot-like noises, copy images of half manuscript formed on A-3 size paper were observed to evaluate dot-like noises caused by toner agglomerates. The evaluations were ranked as follows.

| | |
|---|---|
| ○: | No dot-like noises |
| Δ: | A few dot-like noises in copy images were recognized but paid no attention to. |
| X: | Many dot-like noises in copy images were recognized. |
| XX: | Countless dot-like noises in copy images were recognized. |

Copy images ranked equal to or higher than Δ are acceptable from the standpoint of practical use. Results of the evaluation are shown in Table V-1.

With respect to image-flow, the copying machine was left under a temperature of 30° C. and a humidity of 85% for one day after 200,000 times, 400,000 time and 600,000 times of copy and then image-flow in copy images were observed to be ranked as follows:

| | |
|---|---|
| ○: | Image flow was not recognized. |
| Δ: | Slight image flow was recognized at character edge portions. |
| X: | Flow of characters was recognized on the whole. |
| XX: | Characters could not be discriminated. |

Copy images ranked equal to or higher than Δ are acceptable from the standpoint of practical use. Results of the evaluation are shown in Table V-1.

TABLE V-1

| | Photosensitive member | Toner | Image-flow | | | Dot-like noise | | |
|---|---|---|---|---|---|---|---|---|
| | | | 200K | 400K | 600K | 200K | 400K | 600K |
| Ex. V-1 | 2 | V-1 | ○ | ○ | Δ | ○ | ○ | Δ |
| Ex. V-2 | 1 | V-3 | ○ | ○ | ○ | ○ | ○ | ○ |
| | 2 | V-2 | ○ | ○ | ○ | ○ | ○ | ○ |
| Ex. V-3 | 2 | V-4 | ○ | ○ | ○ | ○ | ○ | ○ |
| Ex. V-4 | 1 | V-6 | ○ | ○ | Δ | ○ | ○ | Δ |
| | 2 | V-5 | ○ | ○ | Δ | ○ | ○ | Δ |
| Ex. V-5 | 2 | V-7 | ○ | Δ | Δ | ○ | ○ | Δ |
| Ex. V-6 | 1 | V-9 | ○ | ○ | Δ | ○ | ○ | Δ |
| | 2 | V-8 | ○ | Δ | Δ | ○ | ○ | ○ |
| Ex. V-7 | 2 | V-10 | ○ | ○ | ○ | ○ | Δ | Δ |
| Compar. | 1 | V-12 | ○ | X | X | ○ | X | X |
| Ex. V-1 | 2 | V-11 | ○ | Δ | X | ○ | X | XX |
| Compar. | 1 | V-14 | X | XX | — | ○ | ○ | — |
| Ex. V-2 | 2 | V-13 | X | XX | — | ○ | ○ | — |
| Compar. | 1 | V-16 | ○ | ○ | Δ | ○ | Δ | X |
| Ex. V-3 | 2 | V-15 | ○ | ○ | ○ | ○ | X | XX |

With respect to Toners V-13 and V-14 in Comparative Examples V-2, after 400,000 times of copy, image flow became remarkable, the durability test with respect to copy was stopped.

What is claimed is:

1. A method for image formation, comprising the steps of:

forming an electrostatic latent image on an image supporting member having a carbon-based high-hardness surface coating layer;

developing the electrostatic latent image with a toner which comprises resin particles composed of at least a binder resin and a colorant, fine particles for preventing post-treatment fine particles from being embedded and post-treatment fine particles, said fine particles fixed on the surface of the resin particles and selected from titanium oxide-based fine particles, magnetic fine particles, silica fine particles and organic fine particles, and said post-treatment fine particles mixed with the resin particles on the surface of which the fine particles are fixed, wherein an amount of addition of the post-treatment fine particles is 0.05 to 5% by weight relative to the resin particles; and transferring a resulting toner image onto a transfer member.

2. The method for image formation according to claim 1, wherein Vickers hardness of the carbon-based high-hardness surface coating layer is not less than 50.

3. The method for image formation according to claim 1, further comprising the step of removing a residual toner on the image supporting member by a cleaning blade after the transferring step.

4. The method for image formation according to claim 1, wherein the carbon-based high-hardness surface coating layer has a proportion of not less than 30% occupied by the number of carbon atoms out of the total number of atoms.

5. The method for image formation according to claim 1, in which the image supporting member has an amorphous hydrocarbon layer as a carbon-based high-hardness surface coating layer formed on an organic photosensitive layer.

6. The method for image formation according to claim 1, in which the image supporting member has an amorphous silicon carbide layer as a carbon-based high-hardness surface coating layer formed on an amorphous silicon-based photosensitive layer.

7. The method for image formation according to claim 1, wherein when the fine particles for preventing post-treatment fine particles from being embedded are titanium oxide-based fine particles, silica fine particles, or organic fine particles, its amount of addition is 0.5 to 3% by weight relative to the resin particles.

8. The method for image formation according to claim 1, wherein the titanium oxide-based fine particles are at least one kind selected from the group consisting of $TiO_2$, $BaTiO_3$, $SrTiO_3$, $CaTiO_3$ and $TiO_2$ treated for electrically conduction with tin oxide.

9. The method for image formation according to claim 1, wherein the fine particles for preventing post-treatment agents from being embedded are magnetic fine particles, their amount of addition being 1.0 to 10% by weight relative to the resin particles.

10. The method for image formation according to claim 1, the organic fine particles are those having a Rockwell hardness 10 or more higher than that of the binder resin.

11. The method for image formation according to claim 1, wherein the fine particles for preventing post-treatment agents from being embedded have a primary particle volume-average particle size of 0.01 to 2 μm.

12. The method for image formation according to claim 1, wherein the fine particles for preventing post-treatment agents from being embedded are embedded in the resin particles by 30% of its volume or greater.

13. The method for image formation according to claim 1, wherein the fine particles for preventing post-treatment agents from being embedded are hydrophobically treated with a hydrophobic treatment agent.

14. The method for image formation according to claim 1, wherein the post-treatment fine particles are inorganic fine particles having a volume-average particle size of 0.01 to 5 μm.

15. The method for image formation according to claim 14, the post-treatment fine particles are hydrophobically treated with a hydrophobic treatment agent.

16. The method for image formation according to claim 14, wherein the post-treatment fine particles are at least one kind of inorganic fine particles selected from the group consisted of silica, titanium dioxide, alumina, magnesium fluoride, silicon carbide, boron carbide, titanium carbide, zirconium carbide, boron nitride, titanium nitride, zirconium nitride, magnetite, molybdenum disulfide, magnesium stearate and zinc stearate.

17. The method for image formation according to claim 1, wherein the toner further contains offset-inhibitor in such a proportion of 1 to 15 parts by weight relative to 100 parts by weight of resin in the toner.

18. The method for image formation according to claim 1, wherein the toner further contains magnetic materials in such a proportion of 1 to 80 parts by weight relative to 100 parts by weight of resin in the toner.

19. The method for image formation according to claim 1, wherein the toner further contains charge controlling agents in such a proportion of 0.1 to 10 parts by weight relative to 100 parts by weight of resin in the toner.

20. A method for image formation, comprising the steps of:

forming an electrostatic latent image on an image supporting member having a carbon-based high-hardness surface coating layer;

developing the electrostatic latent image with a toner which comprises resin particles composed of at least of a binder resin and a colorant, alumina fine particles fixed on the surface of the resin particles and post-treatment fine particles mixed with the resin particles on the surface of which the alumina fine particles are fixed, and said post-treatment fine particles having a BET specific surface area of not more than 300 $m^2/g$; and transferring a resulting toner image onto a transfer member.

21. The method for image formation according to claim 20, wherein the image supporting member has an amorphous hydrocarbon layer as a carbon-based high-hardness surface coating layer formed on an organic photosensitive layer.

22. The method for image formation according to claim 20, wherein the image supporting member has an amorphous silicon carbide layer as a carbon-based high-hardness surface coating layer formed on an amorphous silicon-based photosensitive layer.

23. The method for image formation according to claim 20, wherein the alumina fine particles have a BET specific surface area of 10 to 200 $m^2/g$.

24. The method for image formation according to claim 20, wherein the alumina fine particles are hydrophobically treated with a hydrophobic treatment agent.

25. The method for image formation according to claim 20, wherein the post-treatment fine particles are hydrophobically treated with a hydrophobic treatment agent.

26. The method for image formation according to claim 18, wherein the alumina fine particles are embedded in the resin particles by 30% of their volume or greater.

27. The method for image formation according to claim 20, wherein an amount of addition of the alumina fine particles is 0.5 to 3% by weight relative to the resin particles.

28. The method for image formation according to claim 20, wherein an amount of addition of the post-treatment fine particles is 0.05 to 5% by weight relative to the resin particles.

29. The method for image formation according to claim 20, further comprising the step of removing a residual toner on the image supporting member by a cleaning blade after the transferring step.

30. A method for image formation, comprising the steps of:

forming an electrostatic latent image on an image supporting member having a carbon-based high-hardness surface coating layer;

developing the electrostatic latent image with a toner which comprises resin particles composed of at least a binder resin and a colorant, fine particles for preventing post-treatment fine particles from being embedded and post-treatment fine particles, said fine particles fixed on the surface of the resin particles and selected from titanium oxide-based fine particles, magnetic fine particles, silica fine particles and organic fine particles, and said post-treatment fine particles mixed with the resin particles on the surface of which the fine particles are fixed, wherein the titanium oxide-based fine particles are at least one kind selected from the group consisting of $TiO_2$, $BaTiO_3$, $SrTiO_3$, $CaTiO_3$, and $TiO_2$ treated for electrical conduction with tin oxide; and transferring a resulting toner image onto a transfer member.

31. A method for image formation, comprising the steps of:

forming an electrostatic latent image on an image supporting member having a carbon-based high-hardness surface coating layer;

developing the electrostatic latent image with a toner which comprises resin particles composed of at least a binder resin and a colorant, fine particles for preventing post-treatment fine particles from being embedded and post-treatment fine particles, said fine particles fixed on the surface of the resin particles and selected from titanium oxide-based fine particles, magnetic fine particles, silica fine particles and organic fine particles, and said post-treatment fine particles mixed with the resin particles on the surface of which the fine particles are fixed, wherein the organic fine particles are those having a Rockwell hardness of 10 or more higher than that of the binder resin; and transferring a resulting toner image onto a transfer member.

32. A method of image formation, comprising the steps of:

forming an electrostatic latent image on an image supporting member having a carbon-based high-hardness surface coating layer;

developing the electrostatic latent image with a toner which comprises resin particles composed of at least a binder resin and a colorant, fine particles for preventing post-treatment fine particles from being embedded and post-treatment fine particles, said fine particles fixed on the surface of the resin particles and selected from titanium oxide-based fine particles, magnetic fine particles, silica fine particles and organic fine particles, and said post-treatment fine particles mixed with the resin particles on the surface of which the fine particles are fixed, wherein the fine particles for preventing post-treatment agents from being embedded are embedded in the resin particles by 30% of its volume or greater; and transferring a resulting toner image onto a transfer member.

33. A method for image formation, comprising the steps of:

forming an electrostatic latent image on an image supporting member having a carbon-based high-hardness surface coating layer;

developing the electrostatic latent image with a toner which comprises resin particles composed of at least a binder resin and a colorant, fine particles for preventing post-treatment fine particles from being embedded and post-treatment fine particles, said fine particles fixed on the surface of the resin particles and selected from titanium oxide-based fine particles, magnetic fine particles, silica fine particles and organic fine particles, and said post-treatment fine particles mixed with the resin particles on the surface of which the fine particles are fixed, wherein the post-treatment fine particles are inorganic fine particles having a volume-average particle size of 0.01 to 5 μm; and transferring a resulting toner image onto a transfer member.

34. The method for image formation according to claim 33, wherein Vickers hardness of the carbon-based high-hardness surface coating layer is not less than 50.

35. The method for image formation according to claim 33, further comprising the step of removing a residual toner on the image supporting member by a cleaning blade after the transferring step.

36. The method for image formation according to claim 33, wherein the carbon-based high-hardness surface coating layer has a proportion of not less than 30% occupied by the number of carbon atoms out of the total number of atoms.

37. The method for image formation according to claim 33, in which the image supporting member has an amorphous hydrocarbon layer as a carbon-based high-hardness surface coating layer formed on an organic photosensitive layer.

38. The method for image formation according to claim 33, in which the image supporting member has an amorphous silicon carbide layer as a carbon-based high-hardness surface coating layer formed on an amorphous silicon-based photosensitive layer.

39. The method for image formation according to claim 33, wherein the fine particles for preventing post-treatment agents from being embedded have a primary particle volume-average particle size of 0.01 to 2 μm.

40. The method for image formation according to claim 33, wherein the fine particles for preventing post-treatment agents from being embedded are embedded in the resin particles by 30% of its volume or greater.

41. The method for image formation according to claim 33, wherein the fine particles for preventing post-treatment agents from being embedded are hydrophobically treated with a hydrophobic treatment agent.

42. The method for image formation according to claim 33, the post-treatment fine particles are hydrophobically treated with a hydrophobic treatment agent.

43. The method for image formation according to claim 33, wherein the post-treatment fine particles are at least one kind of inorganic fine particles selected from the group consisted of silica, titanium dioxide, alumina, magnesium fluoride, silicon carbide, boron carbide, titanium carbide, zirconium carbide, boron nitride, titanium nitride, zirconium nitride, magnetite, molybdenum disulfide, magnesium stearate and zinc stearate.

* * * * *